US005946843A

United States Patent [19]

Paananen

[11] Patent Number: 5,946,843

[45] Date of Patent: Sep. 7, 1999

[54] METHOD AND CLEANING AGENT COMPOSITION FOR CLEANING THE BARREL OF A GUN

[76] Inventor: Markku Paananen, Peltolantie 30-32 G 29, FIN-04400 Jarvenpaa, Finland

[21] Appl. No.: 08/776,282

[22] PCT Filed: Jan. 10, 1995

[86] PCT No.: PCT/FI95/00006

§ 371 Date: Feb. 28, 1997

§ 102(e) Date: Feb. 28, 1997

[87] PCT Pub. No.: WO96/21837

PCT Pub. Date: Jul. 18, 1996

[30] Foreign Application Priority Data

Jan. 7, 1994 [FI] Finland ..... 940085

[51] Int. Cl.[6] ..... F41A 29/00

[52] U.S. Cl. ..... 42/95

[58] Field of Search ..... 42/95; 134/22.14, 134/103.2

[56] References Cited

U.S. PATENT DOCUMENTS

| | | | |
|---|---|---|---|
| 1,484,690 | 2/1924 | Walker | 510/190 |
| 3,037,887 | 6/1962 | Brenner et al. | 134/22 |
| 3,740,883 | 6/1973 | Kyle | 42/1 R |
| 3,814,525 | 6/1974 | Spencer | 401/190 |
| 4,482,469 | 11/1984 | Plötze | 252/155 |
| 4,497,082 | 2/1985 | Kogasaka | 15/104.165 |
| 4,873,778 | 10/1989 | Stipp | 42/95 |

FOREIGN PATENT DOCUMENTS

| | | |
|---|---|---|
| 075 113 | 8/1982 | European Pat. Off. . |
| WO 95/07328 | 3/1995 | WIPO . |

*Primary Examiner*—Charles T. Jordan
*Assistant Examiner*—Meena Chelliah
*Attorney, Agent, or Firm*—Merchant & Gould P.C.

[57] ABSTRACT

The invention relates to a method for cleaning the barrel of a firearm, whereby a foam containing an agent that removes bullet residue is applied into the firearm barrel to be cleaned, the foam is allowed to act for 0.1–30 minutes, whereupon the foam is removed from the barrel.

25 Claims, 3 Drawing Sheets

METHOD AND CLEANING AGENT COMPOSITION FOR CLEANING THE BARREL OF A GUN

The present invention relates to a method for cleaning the barrel of a firearm.

The barrel of a firearm has to be cleaned at regular intervals to remove the remnants of bullets and combustion residue such as soot, powder and bunt grease, accumulated in the barrel. In this context, bullet remnants means the metal residue left in the barrel from bullets, such as, in the case of commonly used bullets containing copper, residue of copper, possible copper compounds and other alloyed metals, e.g. copper and zinc residue and, in the case of lead bullets, lead residue.

Various methods and cleaning agents for the cleaning of a so barrel are known. However, current cleaning methods often involve mechanical cleaning by scrubbing the barrel with a hard brush, such as a bronze brush. For example, in a commonly used cleaning method the cleaning agent contains aluminium particles which scrub off impurities from the barrel surface during mechanical cleaning.

Mechanical scrubbing is a laborious and time-consuming operation. Naturally it also causes wear of the barrel surface, thus shortening the service life of the firearm.

To remove the copper residue left in the barrel from copper bullets, cleaning agents acting chemically on copper have also been tried. This type of cleaning agents usually contain ammonia, and the problem has been that ammonia is very volatile, i.e. the cleaning agent quickly becomes ineffective as the active component evaporates. Furthermore, when such cleaning agents are used, the barrel must nevertheless be cleaned mechanically as well, so they do not eliminate the drawbacks associated with mechanical cleaning. Moreover, the evaporating game are detrimental and undesirable. EP specification 75 113 presents a composition of substances that contains ammonia or amine compounds mixed in a gel to prevent evaporation.

In addition, the commonest cleaning agents currently used are relatively expensive, The object of the present invention is to eliminate the drawbacks referred to above.

A special object of the invention is to produce an effective cleaning method of a new type that reduces the need for mechanical cleaning and thus significantly extends the service life of the barrel.

A further object of the invention is to produce a new type of cleaning method that is faster and more user- friendly than earlier methods.

As for the features characteristic of the invention, reference is made to the claims.

The invention is based on the unexpected observation made during investigations that bullet residue can be removed by using a foam that, in the case of bullets containing copper, contains an alkaloamine and, in the case of bullets containing lead, a nitrate salt. Thanks to the invention, a method has now been discovered that makes it possible to effectively and quickly remove the metal residue left by bullets in a barrel, without damaging the steel of the barrel.

In the method of the invention, ammonia can also be used for the cleaning of a barrel because the foam prevents evaporation of ammonia, so the cleaning agent does not lose any of its effectiveness.

For the first time, the present invention produces a firearm cleaning method that uses a foam containing substances that remove bullet residue. The foam to be used can be produced by using a tenside. The tenside may be any commonly used, foam-producing surface-active substance, such as coconut diethanolamide.

Further, nitrate salt has now been used for the first time as a material that chemically removes bullet residue. It was observed during investigations carried out that lead residue in a barrel reacts due to nitrate salt in a way that allows the lead to be removed from the barrel surface without mechanical scrubbing. The nitric salt used is preferably an inorganic nitrate, such as alkaline nitrate, alkaline earth nitrate or ammonium nitrate, especially sodium nitrate. In the method of the invention, the cleaning can be performed by using any substance that forms a foam, preferably a consistent foam, that contains e.g. exclusively nitrate salt, in which case it is applicable for the cleaning of firers using lead bullets. The PH of the nitrate salt solution is preferably adjusted to an alkaline value if necessary. However,.e.g. in the case of sodium nitrate, no pH adjustment is needed. There is no indication that, when used in the manner described, nitrates cause wear of the steel material of the barrel. The reaction product is removed automatically from the barrel surface, or it can be removed by using only a soft felt plug, i.e. without actual mechanical scrubbing. Thus, when the method of the invention is used, bullet residue can be effectively removed from the barrel by wiping it with a material or plug commonly used for the cleaning of firearms, without damaging the steel material of the barrel.

DESCRIPTION OF THE DRAWINGS

For a more thorough understanding of this invention and its many advantages, reference should be had to the accompanying drawing as follows.

Figure 1:
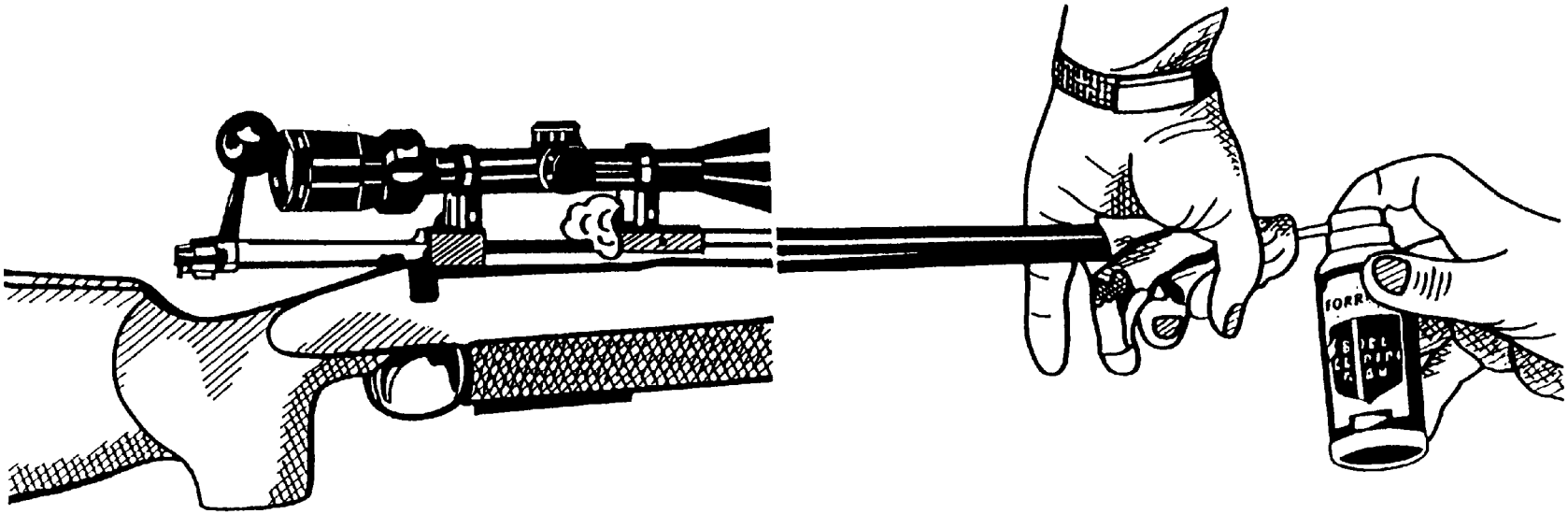
FIG. 1 shows the insertion of a liquid foam into a firearm barrel according to an embodiment of this invention employing spraying the foam through an elastic seal fitted on the barrel end.
Figure 2:
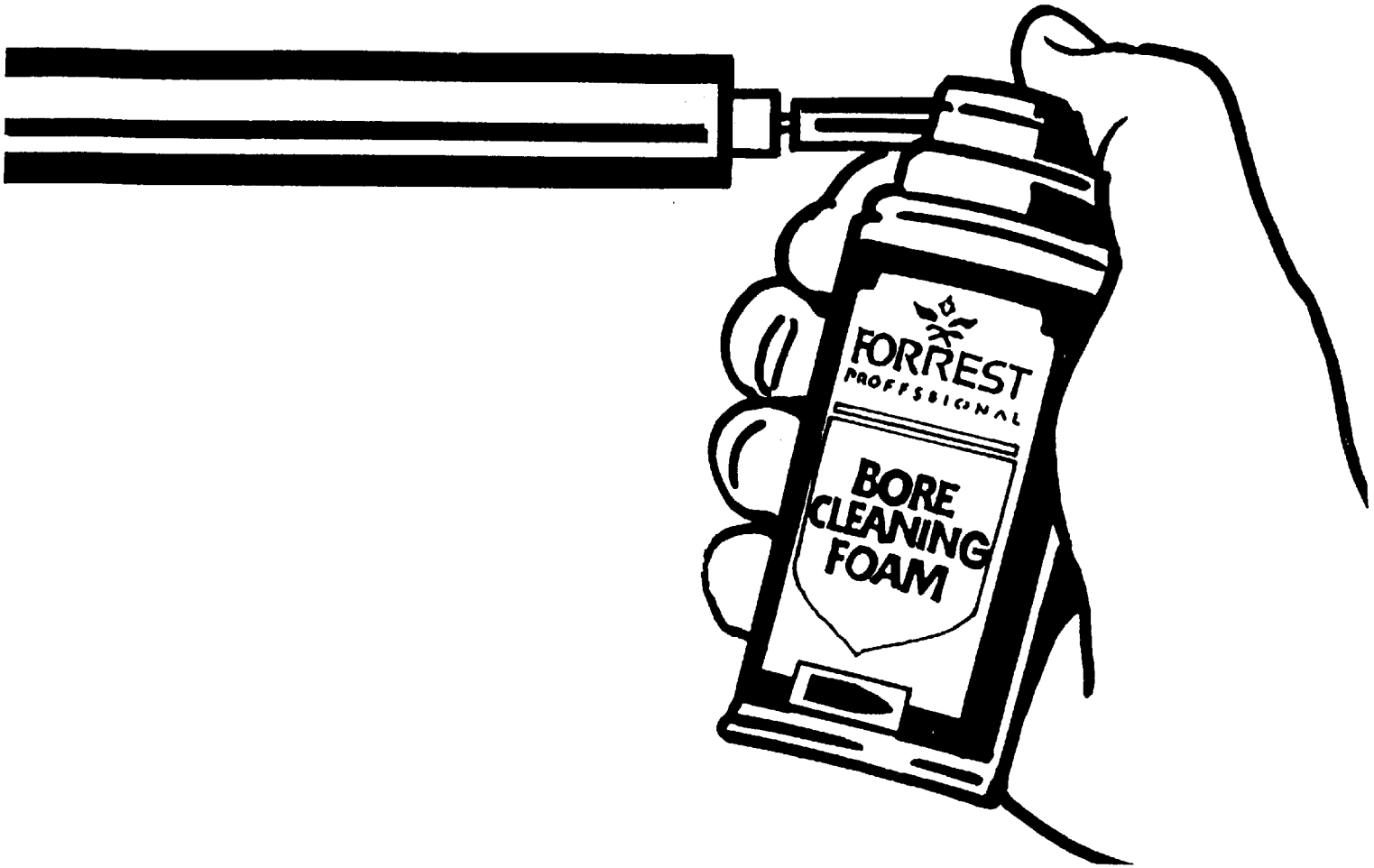
FIG. 2 shows another embodiment of spraying the foam through an elastic seal fitted on the barrel end.
Figure 3:
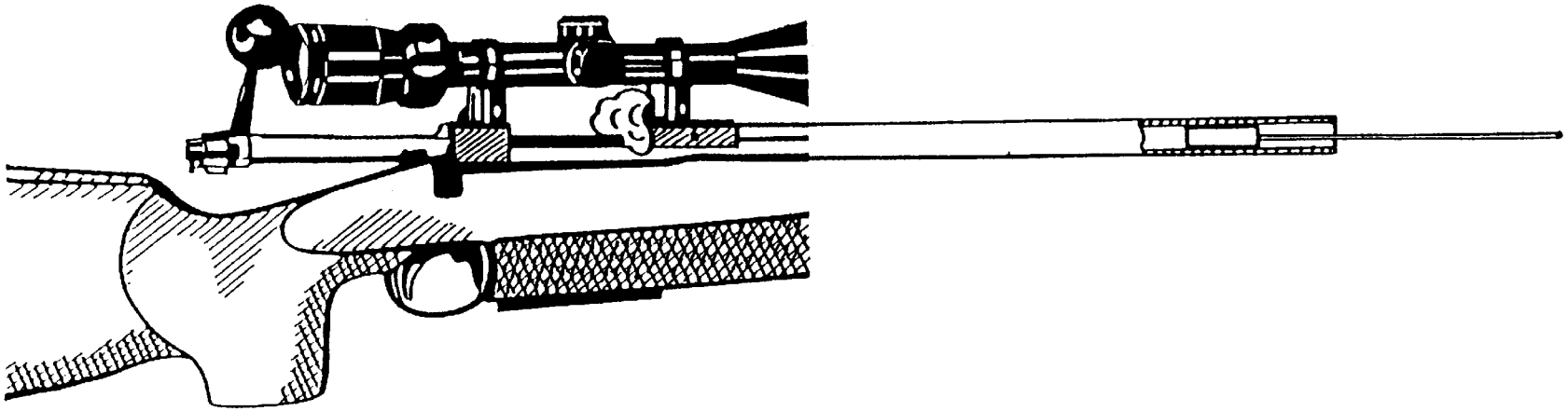
FIG. 3 shows a plug being drawn through a firearm barrel to foam the liquid and form the liquid foam.

In an embodiment of the method of the invention, preferably a consistent foam containing an alkanolamine and/or a nitrate salt is used, in which case the method is applicable for the cleaning of both firearms using lead bullets and firearms using copper/copper compound bullets. In addition to its primary purpose in the method of the invention, the alkanolamine can also be used for the adjustment of the pH of the solution to an alkaline value in connection with solutions containing a nitrate salt. The alkanolamine is preferably monoethanolamine or diethanolamine or a compound of these, especially monoethanolamine.

In the cleaning method of the invention, a foam is used that contains about 1–80 w-%, preferably about 20–70 w-% nitrate salt, such as sodium nitrate, and/or about 1–70 w-%, preferably about 1–30 w-%, e.g. 2–25 w-% alkanolamine, such as monoethanolamine or diethanolamine.

In the method of the invention, a foam is used that preferably additionally contains an organic solvent for the removal of combustion residue such as soot, gunpowder remnants and/or burnt grease. For this purpose, any solvent or solvent., especially a water-soluble/mixable solvent, may be used. In an especially advantageous case, the composition contains under 50 w-%, e.g. 1–15 w-% methylpyrrolidone and/or under 50 w-%, e.g. 1–15 w-% butoxyethanol, which have proved to be effective in removing combustion residue.

The amount of tenside used in the cleaning method is e.g. under 50 w-%, e.g. about 0.1–25 w-% of the composition, depending on the intended application.

The foam used in the cleaning method may further contain about 1–90 w-% added water. By varying the amount of water, it is possible e.g. to adjust the concentrations of the active substances as desired. The amount of water added may be e.g. 5–60 w-%.

In a preferable embodiment, an amount of under 15 w-%, e.g. about 0.1–3 w-%, of sodium salt of m-nitrobenzenesulfonic acid has been added to a composition containing alkanolamine to assist in removing from the barrel surface the reaction products formed by residue from bullets containing copper.

The composition used in the method of the invention may additionally contain an amount of about 0.1–30 w-%, e.g. 1–10 w-%, of a barrel protecting substance, such as commonly known arms oil or preferably so-called cutting lubricant, which may be of semi-synthetic or synthetic type and which prevents copper from sticking to the barrel. The agent used for barrel treatment may be a water-mixable substance or it can be emulsified in water using e.g. a tenside and/or solvent, such as butoxyethanol.

The composition of substances used in the method of the invention can be implemented in any suitable form. Preferably the composition is in the form of a foaming liquid or, suitably, in the form of a spray sprayable as a foam, in which case it is packed in a container equipped to produce a spray, together with propellants if required. The composition may also contain an agent that increases viscosity.

In the following, the invention is described in greater detail by the aid of examples, which are only intended to illustrate the invention without limiting it.

EXAMPLE 1

Producing a composition of substances for use in the cleaning method of the invention.

A cleaning solution composed according to one of the following alternatives is prepared:

| Components | w-% | preferred | composition A | B | C | D | E |
|---|---|---|---|---|---|---|---|
| coconut diethanolamide | 0.1–50 | | 4 | 25 | 2 | 3 | |
| monoethanolamine | 0–70 | 1–30 | 25 | 2 | | 15 | 70 |
| sodium nitrate | 0–70 | 20–70 | 40 | 20 | 70 | 40 | |
| methylpyrrolidone | 0–30 | 1–15 | 5 | 15 | 5 | 10 | 5 |
| 1-butoxyethanol | 0–30 | 1–15 | 5 | 15 | 5 | 10 | 5 |
| sodium salt of m-nitrobenzenesulfonic acid | 0–30 | 0.1–3 | 1 | 3 | 2 | 2 | 10 |
| semi-synthetic cutting lubricant | 0–30 | 1–10 | 10 | 10 | | 10 | 10 |
| water added | 0–60 | 1–30 | 10 | 10 | 12 | 10 | |

when compounding the components, the sodium nitrate is solved in the water added. It can also be added to other components in the form of a rich water solution. Instead of monoethanolamine, other alkanolamines can also be used, such as diethanolamine. When the composition is produced in the form of a foaming liquid, the formulation in performed by using a tenside in an amount of e.g. about 0.1–30 w-%. When the composition is produced in the form of a spray, the amount of tenside used is e.g. 0.1–4 w-%. The concentrations of active components are selected e.g. on the basis of the length of time the cleaning agent is to be allowed to act in the barrel. This action time may vary e.g. between 0.1–30 min., whereupon the composition is removed by using a plug of a medium, e.g. a felt plug.

The finished composition has an alkalic pH value. The cleaning method of the invention is less hazardous to the user and the environment than earlier methods and the composition emits no toxic gases as compared with previous compositions. Moreover, consisting of cheap components, it is advantageous in respect of cost. The composition used does not suffer any loss of efficiency during storage or use. Furthermore, the composition used in the method protects the barrel, and the addition of cutting oil has the effect that a smaller amount of bullet residue, such as copper, sticks to the barrel surface.

Generally, the cleaning method of the invention is applicable for the cleaning of the barrel part of a firearm of any type and any size.

EXAMPLE 2

An experiment was carried out to test the effectiveness and applicability of a cleaning method as provided the invention, designed for firearms using copper/copper compound bullets.

Composition of the foam used in the method

| Components | w-% |
|---|---|
| monoethanolamine | ca.25 |
| methylpyrrolidone | ca. 5 |
| 1-butoxyethanol | ca. 5 |
| sodium salt of m-nitrobenzenesulfonic acid | ca. 1 |
| coconut diethanolamide | ca. 4 |
| water added | ca.50 |
| semi-synthetic cutting lubricant | ca.10 |

The composition was prepared in the for of a spray. To clean a firearm, the foaming alkalic composition was sprayed into the barrel and allowed to act for ca. 10 min., whereupon it was removed by pushing a felt plug through the barrel.

The firearm cleaning method was tested in field conditions during half a year. It was established that the cleaning method worked in cold and hot weather. Moreover, the method was found to be effective and easy to use.

In comparing a barrel cleaned by the method of the invention was compared with a barrel cleaned by the traditional mechanical method, the barrels were inspected using an endoscope and it was established that the barrel treated by the method of the invention was in a considerably better condition, i.e. it showed less wear and burn damage, than the reference barrel. It is estimated that, by using the cleaning method of the invention, the service life of a firearm is extended by about 50%.

What is claimed is:

1. A method for cleaning a firearm barrel comprising:

applying to the inside of the firearm barrel a liquid foam comprising a foam forming agent and a bullet residue removal agent;

allowing the liquid foam to act for about 0.1–30 minutes; and removing the liquid foam from the firearm barrel.

2. The method of claim 1 wherein the liquid foam is allowed to act for about 1–20 minutes inside the firearm barrel.

3. The method of claim 1 wherein the foaming agent comprises a tenside.

4. The method of claim 1 wherein the foaming agent comprises a coconut diethanolamide.

5. The method of claim 1 wherein the foaming agent is under 50 w-% of the liquid foam.

6. The method of claim 5 wherein the foaming agent is 0.1 w-%–25 w-% of the liquid foam.

7. The method of claim 1 wherein applying the liquid foam comprises introducing a liquid into the firearm barrel and drawing a plug through the firearm barrel to foam the liquid and form the liquid foam.

8. The method of claim 1 wherein applying the liquid foam comprises spraying the liquid foam into the firearm barrel from a spray bottle.

9. The method of claim 8 wherein applying the liquid foam comprises spraying the liquid foam from a spray bottle through an elastic seal fitted on a firearm barrel end.

10. The method of claim 1 wherein the bullet residue removal agent comprises an alkanolamine, an inorganic nitrate, or a combination thereof.

11. The method of claim 1, wherein the bullet residue removal agent is an alkanolamine comprising monoethanolamine, diethanolamine, or a combination thereof.

12. The method of claim 1 wherein the bullet residue removal agent comprises a nitrate salt comprising an inorganic nitrate.

13. The method of claim 12 wherein the nitrate salt comprises sodium nitrate.

14. The method of claim 1 wherein the liquid foam comprises a combustion residue removal solvent.

15. The method of claim 1 wherein the liquid foam comprises under 50 w-% butoxyethanol.

16. The method of claim 1 wherein the liquid foam comprises 1–15 w-% butoxyethanol.

17. The method of claim 1 wherein the liquid foam comprises under 50 w-% methylpyrrolidone.

18. The method of claim 1 wherein the liquid foam comprises 1–15 w-% methylpyrrolidone.

19. The method of claim 15 wherein the liquid foam comprises under 50 w-% methylpyrrolidone.

20. The method of claim 16 wherein the liquid foam comprises 1–15 w-% methylpyrrolidone.

21. The method of claim 1 wherein the liquid foam comprises about 0–90 w-% added water.

22. The method of claim 1 wherein the liquid foam comprises less than 5 w-% sodium salt of m-nitrobenzenesulfonic acid.

23. The method of claim 1 wherein the liquid foam comprises a lubricating and protective substance.

24. The method of claim 22 wherein the lubricating and protective substance comprises a semisynthetic cutting lubricant, a synthetic cutting lubricant, or an arms oil.

25. A liquid foam firearm barrel cleaning agent comprising:

a tenside foaming agent and a bullet residue removal substance comprising an alkolamine, a nitrate salt, or a combination thereof;

wherein the agent forms a liquid foam upon cleaning a firearm barrel.

* * * * *